United States Patent [19]

Straitz, III

[11] 4,127,380

[45] Nov. 28, 1978

[54] IGNITION SYSTEM FOR WASTE GAS FLARES WITH GAS COMPENSATION

[75] Inventor: John F. Straitz, III, Meadowbrook, Pa.

[73] Assignee: Combustion Unlimited Incorporated, Elkins Park, Pa.

[21] Appl. No.: 825,522

[22] Filed: Aug. 18, 1977

[51] Int. Cl.[2] ..... F23D 13/20

[52] U.S. Cl. ..... 431/15; 431/63; 431/202

[58] Field of Search ..... 431/15, 63, 191, 192, 431/202

[56] References Cited

U.S. PATENT DOCUMENTS

| | | | |
|---|---|---|---|
| 2,490,729 | 12/1949 | Craver et al. | 431/63 |
| 3,932,111 | 1/1976 | Liknes et al. | 431/202 |
| 4,025,281 | 5/1977 | Lapp | 431/202 |

*Primary Examiner*—Carroll B. Dority, Jr.
*Attorney, Agent, or Firm*—Zachary T. Wobensmith, 2nd; Zachary T. Wobensmith, III

[57] ABSTRACT

An ignition system for combustible waste gas flares is described in which pilots and pilot igniters are employed, the air to gas ratio for pilot ignition being controlled to compensate for the combustible content of the pilot igniter gas, the pilot operation being sensed to control the ratio, controlled intermittent ignition of the pilot igniter gas being provided, with a repetitive cycle in the event of failure of ignition of the pilot igniter gas and of the pilot gas, the operating conditions being visually indicated at a control panel.

15 Claims, 5 Drawing Figures

IGNITION SYSTEM FOR WASTE GAS FLARES WITH GAS COMPENSATION

BACKGROUND OF THE INVENTION

1. Field of the Invention

This invention relates to ignition systems for waste gas flares.

2. Description of the Prior Art

The use of flares and flare stacks for the combustion of waste gas from industrial processes including oil refineries requires that the waste combustible gas delivered to the flare be ignited.

Various ignition systems have heretofore been proposed. While ignition systems have been used in which the ignition of the waste gas is effected at the discharge end of the flare, by hot wires or by igniter flames, a more common practice has been to employ pilots which burn combustible gas. Such pilots require provisions for ignition in order to provide a pilot flame. Various arrangements have heretofore been proposed to ignite the pilot flame.

The presently available pilots and pilot igniters are supplied with combustible gas of substantially uniform content. Insofar as I am aware no provisions have heretofore been made to automatically compensate for variations in the combustible content of the pilot and pilot igniter gas.

SUMMARY OF THE INVENTION

In accordance with the invention an ignition system for combustible waste gas flares having one or more gas pilots is provided in which the pilot gas and the pilot igniter gas are controlled with compensation for variations in the combustible content of the pilot igniter gas, with timed spark actuation for the pilot igniter gas, the control including pilot gas ignition sensing elements, and pilot operation sensing elements, a cyclic repetitive operation being available in the event of the failure of the pilot flame or of the pilot igniter flame.

It is the principal object of the invention to provide an ignition system for combustible waste gas flares in which provision is made for compensation for the combustible content of the waste gas.

It is a further object of the invention to provide an ignition system for combustible waste gas flares employing pilots, and of the character aforesaid, in which the delivery of the gas for the pilots and pilot igniters is controlled by burning of gas at the pilots.

It is a further object of the invention to provide an ignition system for combustible waste gas flares employing pilots, and of the character aforesaid, in which the ignition of the pilots is controlled by the burning of gas at the pilots.

It is a further object of the invention to provide an ignition system for combustible waste gas flares of the character aforesaid and with a pilot igniter in which ignition of the gas for the pilot igniter is controlled by a spark plug activated in a repetitive timed sequence as required by the conditions at the pilots.

It is a further object of the invention to provide an ignition system for combustible waste gas flares having pilots and pilot igniters in which the pilot igniters are purged in a timed sequence.

It is a further object of the invention to provide an ignition system for combustible waste gas flares having pilots and pilot igniters in which control means is provided responsive to an operative level for combustion of an effective gas to air ratio.

It is a further object of the invention to provide an ignition system for combustible waste gas flares of the character aforesaid in which indications of the conditions prevailing at the pilots is visually indicated.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
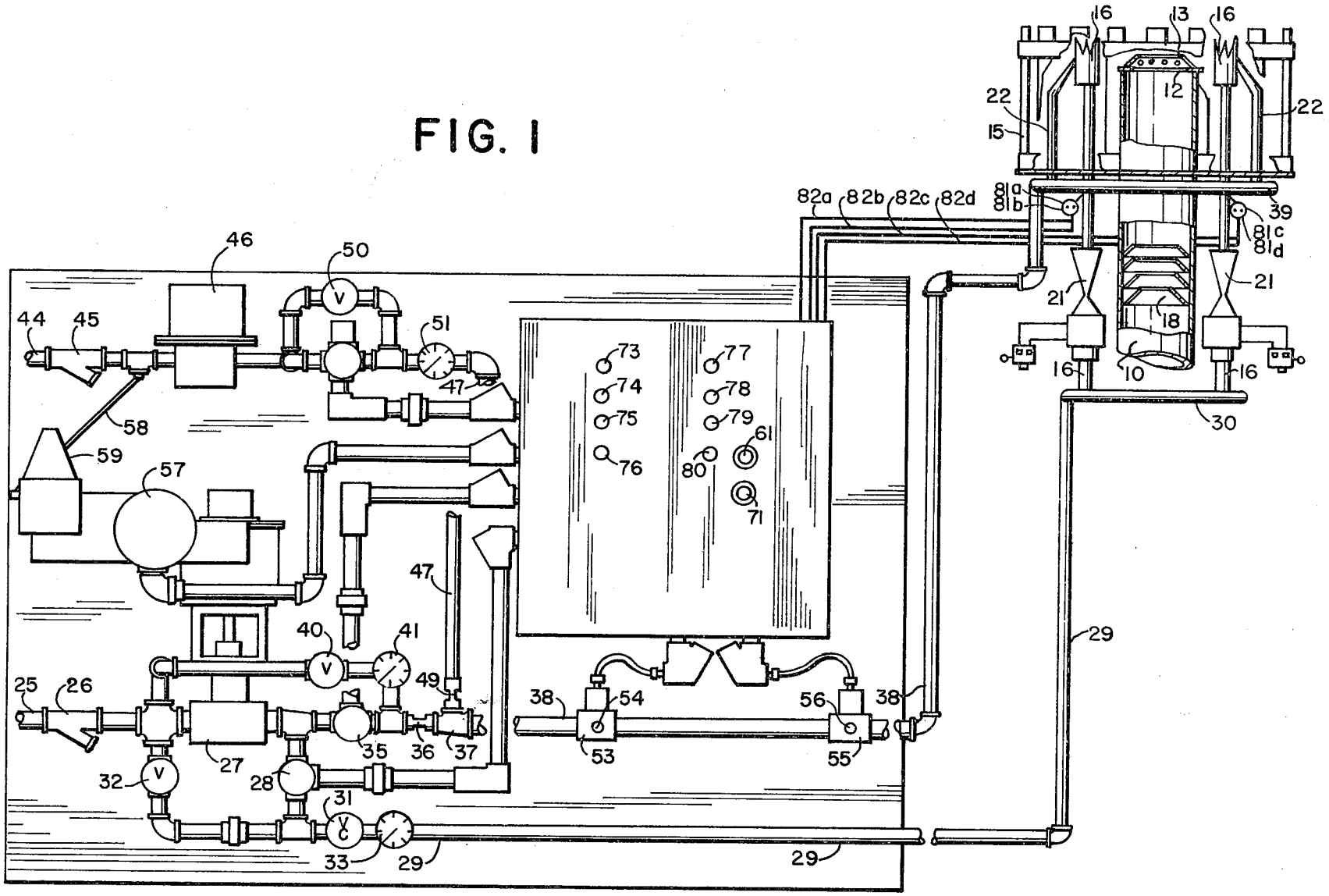
FIG. 1 is a view in elevation and partly diagrammatic of an ignition system in accordance with the invention.
Figure 2:
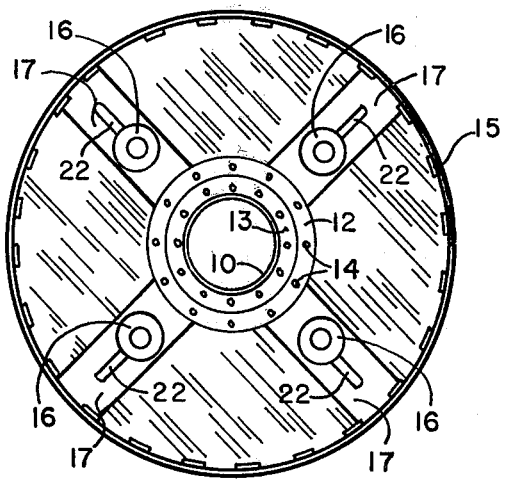
FIG. 2 is a top plan view, enlarged, of the waste gas flare shown in FIG. 1.

Referring now more particularly to FIGS. 1 and 2 of the drawings the combustion terminal end portion of a flare stack 10 is shown diagrammatically to which waste combustible gas is supplied through a waste gas main (not shown).

The stack 10 may be horizontal, vertical or inclined, dependent upon the specific requirements, the stack 10 as illustrated being vertical.

The stack 10 is shown as having a flat burner ring 12 at the discharge end with a frusto-conical inner ring 13 extending therefrom provided with openings 14 for discharge of gas for flame retention. A hollow cylindrical slatted windshield 15 closed at the bottom except for openings 17 for insertion of the pilots 16. The windshield 15 reduces the effect of wind on the pilots 16.

The stack 10, close to the discharge end is preferably provided with a fluidic seal 18 as shown in my U.S. Pat. No. 3,730,673 for permitting free outward flow of gas but for preventing inward flow within the stack 10.

For purposes of illustration, four pilots 16 are shown, equally spaced around the circumference of the stack 10 and between the stack 10 and the windshield 15. A greater or lesser number of pilots 16 can be employed dependent upon the diameter of the stack 10.

Each of the pilots 16 has a gas supply pipe 20, connected thereto, through a venturi 21 for inducing air to support is pilot flame.

Each of the pilots 16 also has an igniter pipe 22 connected thereto for delivery of an igniter flame to the respective pilot 16, as hereinafter explained.

A combustible gas supply pipe 25 is provided for the supply of gas which may vary in its combustible content and is connected to a strainer 26 and a variable flow control valve 27 to an off-on solenoid controlled valve 28 from which a pilot gas supply pipe 29 extends to a pilot gas manifold 30 to which each of the pilots 16 is connected. A manually operable bypass valve 32 is connected around the valves 27 and 28 for manual operation and for use in the event of control system breakdown, if desired. The pipe 29 also has a check valve 31 to prevent backflow of pilot gas to the igniter, and a pressure gage 33 downstream of the valves 27 and 28 for observation of the delivered gas pressure.

An off-on solenoid controlled valve 35 is provided in communication with the flow control valve 27 and is connected through an orifice 36 with a mixing T-fitting connection 37 from which an ignition gas supply pipe 38 extends to an igniter manifold 39 from which the igniter pipes 22 extend.

A manually operable by-pass valve 40 is connected around the valves 27 and 35 for manual operation and for use in the event of control system breakdown, if desired. A pressure gage 41 downstream of the valves 35 and 40 is provided for observation of the delivered gas pressure.

An air supply connection 44 is provided, connected to a supply of air under pressure and through a strainer 45 and an adjustable pressure regulator 46 with pipe 47 extending through an off-on solenoid control valve 48 and an orifice 49 to the mixing T-fitting 37. A manually operable bypass valve 50 is connected around the valve 48 for use in the event of control system breakdown. A pipe 47 also has a pressure gage 51 downstream of the valves 48 and 50 for observaton of the delivered air pressure.

The combustible gas and air delivered to the T-fitting 37 for mixing, and in a controlled ratio suitable for burning pass under pressure to an igniter 53, which may include a spark plug activated in a timed sequence as hereinafter explained. The igniter 53 has a sight port 54.

The gas-air mixture, whether or not it has been ignited, advances past a flame detector 55 of any desired type which has a sight port 56 and which supplies a signal for control purposes. The gas-air mixture whether or not it is ignited moves to the igniter manifold 39 and therefrom through the igniter pipes 22.

The air supply pipe 44 has a pipe 58 extending through a pressure regulator 59 for supplying air for controlled positioning of the valve 27 by a current to pressure transducer 57.

Figure 3:
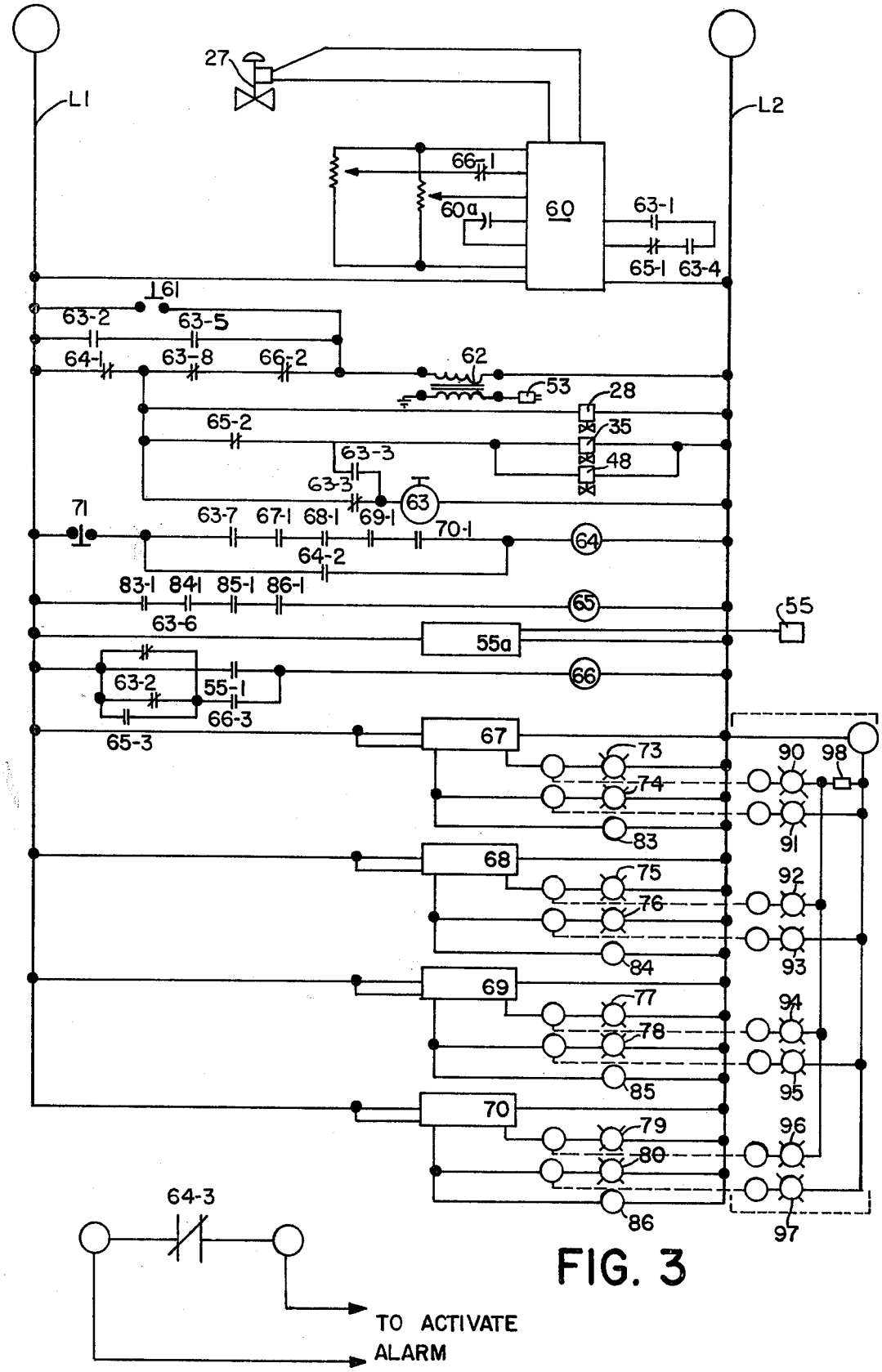
FIG. 3 is a wiring diagram for the ignition system.

A wiring diagram is shown in FIG. 3 with power leads L1 and L2.

In order to regulate the positioning of the valve 27 a ramp function generator 60 is provided (see FIG. 3) whose output current delivered to the valve 27 increases linearly at a rate dependent on the voltage setting of its rate potentiometer to cause the transducer 57 of the valve 27 to effect gradual opening to supply gas to the pilot and pilot igniter.

When the leads L1 and L2 are energized action is initiated and with relay controlled contacts for activating in a predetermined timed relation an ignition transformer 62, a motor driven timer 63, the solenoid valves 28, 35 and 48, lock-out control relay 64, a "run" relay 65, a flame detector relay 66 controlled by the flame detector 55 and amplifier 55*a*, temperature limit alarm controls 67, 68, 69 and 70 for controlling signal lights 73, 74, 75, 76, 77, 78, 79 and 80 for the four pilots 16 shown and associated control relays 83, 84, 85 and 86 and remote lights hereafter referred to.

A manual override pushbutton 61 is provided for manual operation and for use in the event of control system breakdown, if desired.

A reset pushbutton 71 is provided in a conductor leading to lock-out control relay 64.

The ignition transformer 62 is connected to the spark igniter 53 and is energized in timed relation under the control of the timer 63.

The timer 63 provides a programmed sequence cycle commencing at zero time in seconds, T=0, and continuing to T=300, where it may repeat if reset pushbutton 71 is operated.

Figure 4:
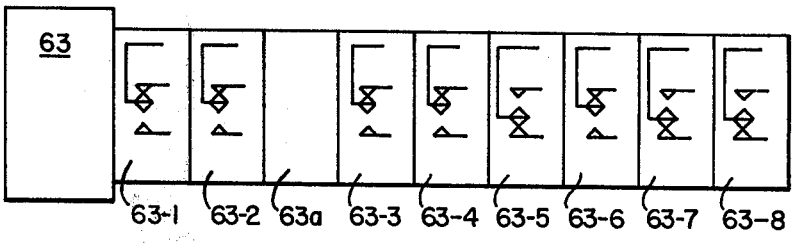
FIG. 4 is a view of certain of the contacts at zero seconds.

The motor driven timer 63, through its control cams, controls in timed relation, a plurality of contacts starting from T=0 as shown in FIG. 4. The contacts controlled by the timer 63 include a normally open reset contact 63-1 for the ramp function generator 60 which in the specific embodiment described is closed at T=0, T=10, T−20 and at each succeeding 10 second interval, and is open at T=0.6, T=10.6, T=20.6 and each succeeding 10 second interval, and a contact 63-2 shunted around the manual override pushbutton 61.

The timer 63 has a speed reducer 63*a* of the order of ten to one for controlling additional contacts.

Contact 63-2 in a conductor connected to the flame detector relay 66 is normally open at T=0, at 10 seconds and at 20 seconds and succeeding 10 second intervals and is closed at 0.8 seconds, 10.8 seconds and 20.8 seconds and at succeeding 10 second intervals.

Contacts 63-3 at T=0 have one normally open and the other normally closed, and are connected from the lead which activates the solenoid valves 28 and 35 to the motor driven timer 63. The open contact is open at 6 seconds and closed at 298 seconds while the other is closed at 6 seconds and open at 298 seconds.

Contacts 63-4 in the reset control circuit for the ramp function generator 60 is normally closed at T=0 and is closed at 98 seconds, 198 seconds, 298 seconds and is open at 6 seconds, 106 seconds and 206 seconds.

Contacts 63-5 in the bypass connection around the pushbutton 61 and in series with the contact 63-2 is normally open at T=0, is closed at 38 seconds, 58 seconds, 78 seconds, 138 seconds, 158 seconds, 238 seconds, 258 seconds and 278 seconds and is normally open at 46 seconds, 66 seconds, 86 seconds, 146 seconds, 166 seconds, 186 seconds, 246 seconds, 266 seconds and 286 seconds.

Contact 63-6 in the conductor to the flame detector relay 66 is normally open at T=0, is open at 98 seconds, 198 seconds and 298 seconds and is closed at 6 seconds, 106 seconds, and 206 seconds.

Contact 63-7 in the conductor which includes the reset pushbutton 71 and the lock out control relay 64 is closed at T=0, is closed at 288 seconds and is open at 296 seconds.

Contact 63-8 in a conductor leading to the ignition transformer 62 is closed at T=0, is closed at 100 seconds, and at 200 seconds, and is open at 20 seconds, 120 seconds and at 220 seconds.

The lock out relay 64 has a normally closed contact 64-1 in the conductor leading to the ignition transformer 62, and a contact 64-2 in a conductor from the reset pushbutton 71 to the lock out control relay 64.

The "run" relay 65 has a normally closed contact 65-1 in the reset circuit of the ramp function generator 60, a normally closed contact 65-2 in the conductor leading to the solenoid valves 28 and 35, and a normally open contact 65-3 in a conductor bypassing the normally closed contact 63-2.

The flame detector relay 66 has a normally closed contact 66-1 in the hold circuit for the ramp function generator 60, a normally closed contact 66-2 in the input conductor to the ignition transformer 62, and a normally open contact 66-3 leading to the relay 66.

Each of the pilots 16 has contiguous thereto a temperature responsive element 81*a*, 81*b*, 81*c* and 81*d*, connected respectively by conductors 82*a*, 82*b*, 82*c* and 82*d* to the temperature limit alarm controllers 67, 68, 69 and 70 for activation, according to the conditions prevailing at the pilots 16, to illuminate a red light at 73, 75, 77 or 79 or a green light at 74, 76, 78 or 80, and to activate the appropriate relays 83, 84, 85 and 86.

The alarm controllers 67, 68, 69 and 70 have normally open contacts 67-1, 68-1, 69-1 and 70-1, in series with the reset pushbutton 71 and the lock out control relay 64 which close in the event of failure of the pilots 16.

The control relays 83, 84, 85 and 86 have normally open contacts 83-1, 84-1, 85-1 and 86-1 in series with the "run" relay 65 which close when the pilots 16 are lighted.

Remote lights may also be provided, if desired. As shown in FIG. 4 remote lights may be employed identified as red signal lights 90, 92, 94 and 96 corresponding respectively with the red signal lights 73, 75, 77 and 79 and activated therewith and as green signal lights 91, 93, 95 and 97 corresponding respectively with the green signal lights 74, 76, 78 and 80 and activated therewith. A flasher 98 may also be provided, activating any of the red signal lights 90, 92, 94 and 96.

The mode of operation will now be pointed out.

It is common practice with flares to purge the stack to prevent explosions occasioned by the entrance of air downwardly within the stack caused by wind or by contraction of gas within the stack upon cooling so that an explosive mixture is present within the stack. Lighted pilots could ignite the explosive mixture with possibility of serious damage to the stack.

The apparatus of the present invention because of the pilots 16 is preferably used with stacks which have been properly purged. The supply of power to the leads L1 and L2 can be made dependent upon proper purging but is not limited to that specific operation.

At initial conditions power is supplied from the leads L1 and L2 to the ramp function generator 60.

The pilot gas solenoid valve 28 will be energized through the closed contacts 64-1 of relay 64. The igniter gas solenoid valve 35 and the igniter air solenoid valve 48 will both be energized through the closed contacts 64-1 of relay 64 and closed contacts 65-1 of relay 65.

The timer 63 will start to move from its home position since it is energized through closed contacts 64-1 of relay 64, closed contacts 65-2 of relay 65, and its own closed "normally open" set of contacts 63-3, or through its normally closed contacts 63-3.

Power will be supplied from the power leads L1 and L2 to the flame detector 55 and the flame detector amplifier 55*a*.

The four red "pilot off" signal lights 73, 75, 77 and 79 will be lit since the thermocouples 81*a*, 81*b*, 81*c* and 81*d* are not sensing any of their pilots 16 as on. The four remote red "pilot off" signal lights 90, 92, 94 and 96 will be flashing. The four sets of contacts 67-1, 68-1, 69-1 and 70-1 of the controls 67, 68, 69 and 70 will be energized in their closed positions with power applied and no flame sensed.

The initial start up operations then take place.

When the timer 63 reaches the beginning of its programmed sequence cycle at zero time ($t=0$), its contacts 63-1 and 63-4 will both be closed and reset the ramp function generator 60. The ignition transformer 62 will be energized through the closed contacts 64-1 of relay 64, contacts 63-8 of timer 63, and contacts 66-2 of relay 66 causing the spark plug 63 to spark continuously for approximately 20 seconds.

The ramp function generator output current will start to increase linearly from its reset value at a rate dependent on the voltage setting of the rate potentiometer 60*a*. This will cause the fuel gas diaphragm for actuator valve 27 to gradually open and start to supply gas to the pilots 16 and igniter 63 through their already open solenoid valves 28 and 35.

With the air being supplied from the initially open solenoid air valve 48 the gas and air will now mix at the mixing T-fixture 37 and be driven by the pressure to the ignition tube 38 where the spark plug 53 is sparking.

When the level of the gas to air mixture has reached the proper level, combustion will take place in the ignition tube 38. After the initial combustion has taken place the gas will continue to burn and create a flame front that will be swept past the flame detector 55 by the mixture velocity.

When the flame detector 55 and its amplifer 55*a* sense the flame front, it will close its own relay contacts 55-1 and energize relay 66. This will open contacts 66-1 of relay 66 to stop the ramp generator 60 and holds its last output current which in turn will hold the gas concentration constant. Relay 66 will be self-held by the normally closed contacts 63-6 or 63-2 of timer 63 and its own closed contacts 66-3, contacts 66-2 will open, stopping the sparking before the 20 second sparking period is completed.

The ignition pipe 38 will now be purged with the gas and air mixture for approximately 20 seconds.

After the purging for 20 seconds, the ignition coil 62 will be energized for approximately 0.8 seconds at T=40 through contacts 63-2 and 63-5. Proper ignition is produced and the burning flame front will be forced through the igniter pipe 38 and then to the manifold 39 for delivery through the pipes 22 to each of the four pilots 16.

If all pilots 16 light, the four flame detection thermocouples 81*a*, 81*b*, 81*c* and 81*d* will sense their flames. This will cause the four temperature limit alarm controls 67, 68, 69 and 70 to open their normally energized relays. This will turn off the four red "pilot off" signal lights 73, 75, 77 and 79, the four flashing remote red "pilot off" signal lights 90, 92, 94 and 96 on the purge control panel and turn on the four green "pilot on" lamps 74, 76, 78 and 80 and the remote lamps 91, 93, 95 and 97. The four temperature limit alarms will each energize a relay connected across their green signal lamps. These relays 83, 84, 85, and 86 will each close their contacts 83-1, 84-1, 85-1 and 86-1 to activate the run relay 65. Energizing the run relay 65 will open its normally closed contacts 65-1 to prevent the ramp generator 60 resetting during the remainder of the timer programmed sequence. Relay 65 will also close its contacts 65-3 and relay 66 will hold its contacts 66-3 to prevent the relay 66 from deenergizing its contacts 66-1 and thus maintain the hold on the ramp generator 60. Contacts 66-2 of relay 66 will also continue to be held open to prevent the last two programmed 20 second sparking sequences from occurring. The last set of contacts 65-2 of relay 65 will be opened to remove power from both the igniter gas solenoid valve 35 and the igniter air solenoid valve 48. This will stop the production of a mixture of gas and air by stopping the gas and air flow, which is no longer needed since ignition has been achieved.

The normally closed contacts 63-3 of timer 63 will stay closed until T=298 seconds to home the timer 63. At approximately T=298 seconds these contacts will open and the programmed timer 63 will stop. The programmed short duration sparking (0.8 second) will occur until the timer 63 has reached its home position.

If any pilot 16 fails to light on initial start-up, the run relay 65 will not be energized because one of the relay contacts 83-1. 84-1, 85-1 or 86-1 in series with it will still be open. One of the temperature limit alarm controls 67, 68, 69 and 70 will not have had its thermocouple 81*a*, 81*b*, 81*c* or 81*d* sense a pilot flame at its corresponding pilot 16 and will not have energized the relay 83, 84, 85 or 86 across green "pilot on" signal light 74, 76, 78 or 80. This temperature limit alarm control 67, 68, 69 or 70 would still show a red "pilot off" signal light 73, 75, 77 or 79 lit on the cabinet and a flashing red signal light 90, 92, 94 or 96 on the remote purge control panel.

The gas and air mixture will still be supplied to the ignition tube 38 since the normally closed contacts 65-1 of relay 65 did not open. The ignition tube 38 will again be purged for approximately 20 seconds. At T=60 the ignition coil 62 will again be energized for approximately 0.8 seconds through contacts 63-2 and 63-5.

If ignition of the gas pilots 16 still fails at T=60 they will be purged and ignition of pilots 16 will be attempted again at T=80.

If all pilots 16 are not lit at T=100, the timer 63 will reset the ramp function generator 60 through contacts 63-1 and 63-4. This will close down the fuel gas diaphragm actuator valve 27.

Also at T=100, the contacts 63-2 and 63-6 of timer 63 will both be open for approximately 0.8 seconds to deenergize relay 66 from self-holding itself. This will close the normally closed contacts 66-1 of relay 66, will start the ramp function generator 60 output to increase linearly and start opening the fuel gas diaphragm actuator valve 27. The ignition transformer 62 will be energized through the normally closed contacts 64-1 of relay 64, the now closed contacts 63-8 and contacts 66-2 of relay 66 causing the spark plug 53 to spark continuously for approximately 20 seconds. When the ratio of the gas to air mixture reaches the proper level, combustion will take place in the ignition tube 38 and the flame detector 55 will sense this and energize relay 66. This will cause the ramp generator 60 to hold its output as then set and will stop the 20 second sparking interval. The timer 63 will then cause it to purge three times for approximately 20 seconds and try to ignite the pilots 16 after each purge at times T=140, T=160, T=180 similar to the first ramp cycle.

If all the pilots 16 are lit at any time during this last sequence, the ramp generator 60 will be prevented from resetting. Its output will continue to be held and prevented from changing because relay 66 will be prevented from deenergizing by contacts 65-2 of relay 65. The gas and air mixture supply will be stopped. The timer 63 will advance to the home position and stop.

If all the pilots 16 are not lit by T=200 the complete sequence will take place for a third time, that is resetting the ramp generator 60 and starting it ramping determining the point of combustion, holding the ramp generator output, purging and sparking it three times every 20 seconds. If all pilots 16 become lit the timer 63 advances to its home position and stops, but if they are not all lit the programmed sequence will continue until they all light or lock-out occurs at 300 seconds.

If pilot failure should occur after all the pilots 16 have been lit, the timer 63 will be in its home position located near the end of the 300 second timer sequence or really a few seconds prior to the beginning of the sequence again.

When a pilot 16 fails its thermocouple 81*a*, 81*b*, 81*c* or 81*d* will sense no flame and its temperature limit alarm control 67, 68, 69 or 70 will switch its output green signal lights 74, 76, 78 and/or 80 off and turn on the red signal lights 73, 75, 77 and/or 79 as well as its flashing red signal lights 90, 92, 94 and/or 96 on a remote control panel. The relay 83, 84, 85 and/or 86 across its green signal light will be deenergized and stop power to the run relay 65.

Power will now be supplied to the programmed timer 63 through contacts 64-1, contacts 65-2 and the closed "normally open" contacts 63-3 of timer 63. This will power the timer 63 to start and begin the programmed timer sequence that starts at T=0.

The procedure will now continue as described above for initial start-up operation to relight the pilots 16. If the pilots 16 are not lit the operation will continue as described above if the pilots 16 fail to light during initial start-up operation.

If all the pilots 16 fail to light the sequence will follow the same as with a single pilot 16 not lighting, except when the timer 63 reaches approximately 288 seconds, contacts 63-7 as well as contacts 67-1, 68-1, 69-1 and 70-1 of the temperature limit alarm control relays 67, 68, 69 and 70 will all be closed. This will energize the lock-out relay 64 which will self-hold itself with its contacts 64-2. Relay 64 will open its contacts 64-1 and cut off power to the ignition transformer 62, pilot gas solenoid valve 28, gas solenoid valve 35, air solenoid valve 48 and the timer 63. Relay 64 can also control relay contacts 64-3 for alarm circuit for indicating when all pilots 16 are out. Pressing the reset push-button 71 will allow the timer 63 to recycle through the complete programmed sequence cycle. If all the pilots fail after all the pilots 16 have been lit the four thermocouples 81*a*, 81*b*, 81*c* and 81*d* will sense no flame and the temperature limit alarm controls 67, 68, 69, and 70 will switch their output green signal lights 74, 76, 78 and 80 off and switch on the four red signal lights 73, 75, 77 and 79 as well as the four flashing red signal lights 90, 92, 94 and 96 in the remote control panel.

The timer 63 will be started as though it was a single pilot failure and to light all the pilots 16. If at least one pilot 16 is then lit the sequence will continue until all pilots 16 are operating, but if none light it will stop after it has run through the programmed sequence at T=288 and energize the alarm relay 64 with its contacts 64-3.

Figure 5:
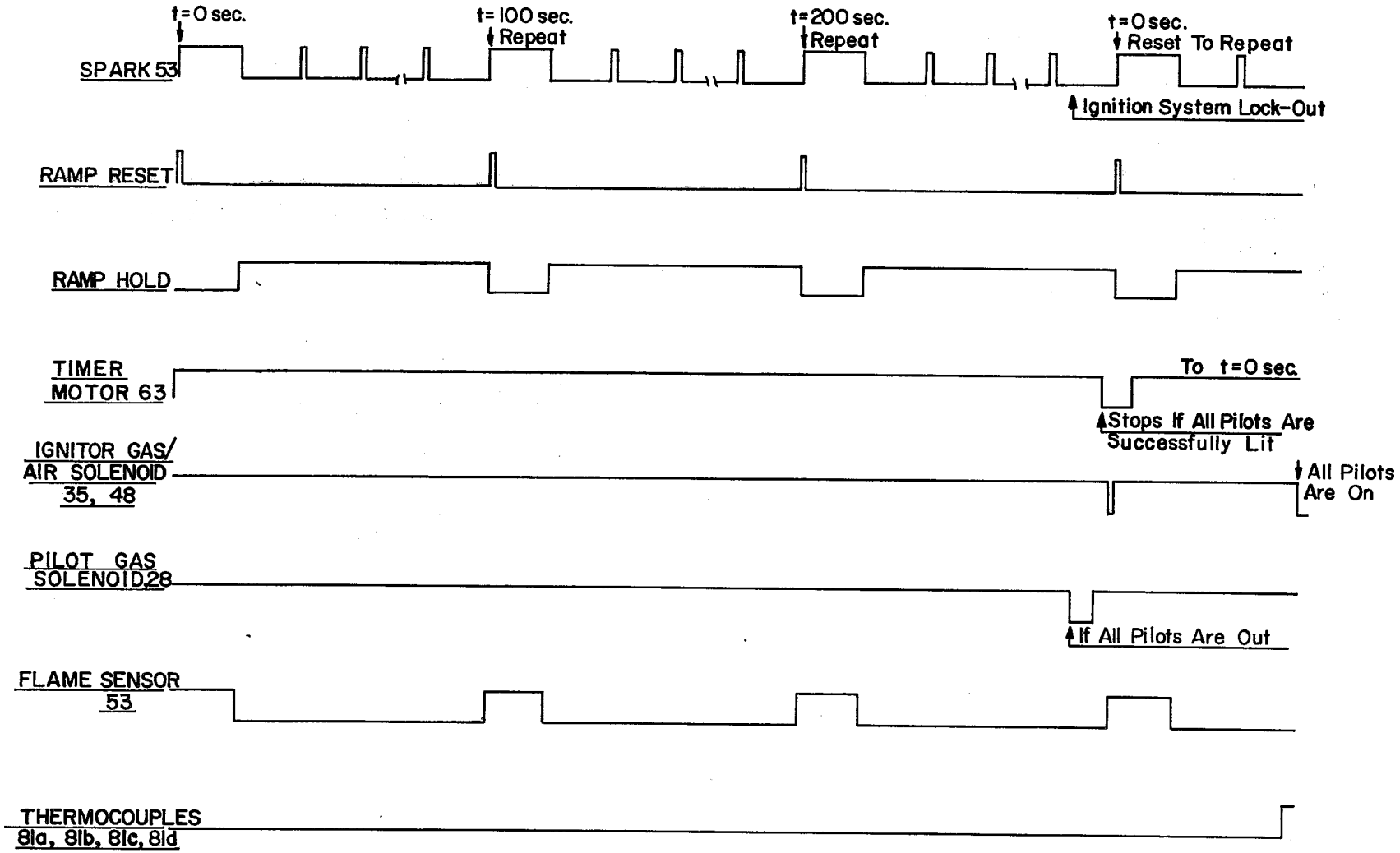
FIG. 5 is a view showing the operating sequence of major components of the system.

The sequences as heretofore described are illustrated graphically in FIG. 5, and showing the timed actuation of the ignition spark 53, the reset and hold of the ramp function generator 60, the timer motor 63, the ignition gas and air solenoids 35 and 48, the pilot gas solenoid 28, the flame sensor 55, its amplifer 55*a*, and its relay 66 and the thermocouples 81*a*, 81*b*, 81*c* and 81*d*.

I claim:

1. An ignition system for flares comprising a pilot for igniting gas discharged from the flare, an igniter pipe extending to said pilot for igniting said pilot, means for supplying air under pressure, means for supplying fuel gas for delivery to said pilot, an ignition coupling to which a mixture of fuel gas from said source of gas and air from said means for supplying air are delivered and which is connected to said ignition pipe, means for igniting the gas-air mixture at said ignition coupling for delivery of an igniter flame through said igniter pipe to said pilot, flame sensing means for said ignition pipe, and means upstream of said ignition coupling for controlling the ratio of fuel gas to air responsive to said flame sensing means.

2. An ignition system as defined in claim 1 in which said means for igniting includes an ignition transformer and a timer for intermittent actuation of said means for igniting.

3. An ignition system as defined in claim 1 in which pilot condition indicating means is provided.

4. An ignition system as defined in claim 1 in which shut-off members are provided for the fuel gas to said pilot, the fuel gas to said ignition coupling and the air to said ignition coupling.

5. An ignition system as defined in claim 1 in which pilot condition responsive means is provided for controlling said means for igniting.

6. An ignition system as defined in claim 1 in which said last mentioned means includes a ramp function generator for controlling said gas to air ratio.

7. An ignition system as defined in claim 6 in which said ramp function generator is effective to increase the supply of gas.

8. An ignition system as defined in claim 6 in which control members are provided, responsive to said flame sensing means, for holding said ramp function generator at a selected level.

9. An ignition system as defined in claim 1 in which members are provided for purging said igniter pipe in predetermined timed relation.

10. An ignition system as defined in claim 2 in which a control member is provided for discontinuing operation of said timer when said pilot is ignited.

11. An ignition system as defined in claim 1 in which additional pilots and igniter pipes are provided, additional pilot condition responsive means is provided for said pilots, and control members are provided for repetitive actuation of said gas-air mixture igniting means.

12. An ignition system as defined in claim 1 in which additional pilots and igniter pipes are provided, and condition indicators are provided for each of said additional pilots.

13. An ignition system as defined in claim 12 in which additional pilot condition indicators are provided actuated with said first mentioned condition indicators.

14. An ignition system as defined in claim 13 in which certain of said condition indicators are continuously intermittently actuated.

15. An ignition system as defined in claim 1 in which pilot condition sensing means is provided for controlling said gas-air mixture igniting means.

* * * * *